US010808301B2

(12) United States Patent
Ienaga et al.

(10) Patent No.: US 10,808,301 B2
(45) Date of Patent: Oct. 20, 2020

(54) MAGNESIUM ALLOY AND METHOD OF MANUFACTURING SAME

(71) Applicant: HONDA MOTOR CO., LTD., Tokyo (JP)

(72) Inventors: Yuichi Ienaga, Wako (JP); Masao Ishida, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 374 days.

(21) Appl. No.: 15/145,075

(22) Filed: May 3, 2016

(65) Prior Publication Data

US 2016/0348217 A1 Dec. 1, 2016

(30) Foreign Application Priority Data

May 27, 2015 (JP) ..... 2015-107787

(51) Int. Cl.

| | |
|---|---|
| ***C22C 23/00*** | (2006.01) |
| ***C22C 23/02*** | (2006.01) |
| ***C22C 1/02*** | (2006.01) |
| ***C22C 21/02*** | (2006.01) |
| ***C22C 23/06*** | (2006.01) |

(52) U.S. Cl.

CPC ..... *C22C 23/00* (2013.01); *C22C 1/02* (2013.01); *C22C 21/02* (2013.01); *C22C 23/02* (2013.01); *C22C 23/06* (2013.01)

(58) Field of Classification Search

None

See application file for complete search history.

(56) References Cited

U.S. PATENT DOCUMENTS

| | | | | |
|---|---|---|---|---|
| 4,997,622 | A | 3/1991 | Regazzoni et al. | |
| 5,088,063 | A | 2/1992 | Matsuda et al. | |
| 6,264,763 | B1 | 7/2001 | Powell et al. | |
| 6,467,527 | B1 * | 10/2002 | Kubota | B22D 17/08 164/113 |
| 10,358,702 | B2 * | 7/2019 | Kawamura | B21B 3/00 |

(Continued)

FOREIGN PATENT DOCUMENTS

| | | | |
|---|---|---|---|
| CN | 1614064 | A | 5/2005 |
| CN | 1796024 | A | 7/2006 |

(Continued)

OTHER PUBLICATIONS

Rao Li, Effects of silicon on mechanical properties of AM60 magnesium alloy, China Foundry, vol. 9 No. 3 (Year: 2012).*

(Continued)

*Primary Examiner* — Colleen P Dunn
*Assistant Examiner* — Michael J Kachmarik
(74) *Attorney, Agent, or Firm* — Westerman, Hattori, Daniels & Adrian, LLP

(57) ABSTRACT

A magnesium alloy is provided which does not contain a rare earth and which achieves, in a high-temperature region of about 200° C., both satisfactory mechanical properties and thermal conductivity. A magnesium alloy including Mg, Ca, Al and Si, where a content of Ca is less than 9.0 mass %, a content of Al is equal to or more than 0.5 mass % but less than 5.7 mass %, a content of Si is equal to or less than 1.3 mass % and Al+8Ca≥20.5%.

13 Claims, 2 Drawing Sheets

(56) References Cited

U.S. PATENT DOCUMENTS

| | | | | |
|---|---|---|---|---|
| 2004/0091384 | A1* | 5/2004 | Tanaka | C22C 23/00 420/407 |
| 2008/0311423 | A1 | 12/2008 | Numano et al. | |
| 2014/0010702 | A1* | 1/2014 | Kim | B22D 21/007 420/407 |
| 2016/0369378 | A1* | 12/2016 | Kawamura | C22C 23/02 |

FOREIGN PATENT DOCUMENTS

| | | | |
|---|---|---|---|
| CN | 103045922 | A | 4/2013 |
| EP | 0990710 | A | 4/2000 |
| JP | H03-017890 | A | 1/1991 |
| JP | 06-025790 | A | 2/1994 |
| JP | H10-008160 | A | 1/1998 |
| JP | 2000-104137 | A | 4/2000 |
| JP | 2000-319744 | A | 11/2000 |
| JP | 3415987 | B2 | 6/2003 |
| JP | 4852082 | B2 | 1/2012 |
| JP | 2013-19030 | A | 1/2013 |
| JP | 2014-1428 | A | 1/2014 |
| JP | 5674136 | B2 | 2/2015 |
| WO | 2006/003899 | A1 | 1/2006 |

OTHER PUBLICATIONS

Office Action dated Jun. 30, 2017, issued in counterpart Chinese Application No. 201610150773.7, with English translation. (20 pages).

Office Action dated Dec. 11, 2018, issued in counterpart Japanese Application No. 2015-107787, with English translation (7 pages).

Alan A. Lou, et al., "Creep and Microstructure of Magnesium-Aluminum-Calcium Based Alloys", Metallurgical and Materials Transactions A, vol. 33A, Mar. 2002, pp. 567-574, cited in JP Written Opposition dated May 12, 2020. (8 pages).

Written Opposition dated May 12, 2020, issued in counterpart JP application No. 2015-107787. (37 pages).

* cited by examiner

MAGNESIUM ALLOY AND METHOD OF MANUFACTURING SAME

This application is based on and claims the benefit of priority from Japanese Patent Application No. 2015-107787, filed on 27 May 2015, the content of which is incorporated herein by reference.

BACKGROUND OF THE INVENTION

Field of the Invention

The present invention relates to a magnesium alloy and a method of manufacturing such a magnesium alloy.

Related Art

Since magnesium is lighter than iron and aluminum, it is examined to use magnesium as a lightweight alternative material which replaces a member formed of an iron and steel material or an aluminum alloy material. As a magnesium alloy excellent in mechanical properties, casting and the like, AZ91D is known.

However, in a general magnesium alloy, mechanical properties such as a tensile strength and creep elongation are lowered in a high-temperature region of about 200° C., and thus, it is impossible to obtain a high-temperature strength comparable to a heat-resistant aluminum alloy such as an ADC 12 material or an A4032-T6 material.

Conventionally, as a commercially available magnesium alloy which satisfies a high high-temperature strength, WE54 is known. However, since in this Mg alloy, a large amount of expensive rare earth such as Y or a misch metal is added to achieve a high high-temperature strength, its cost is increased.

Hence, an Mg—Al—Ca—Si-based alloy is proposed in which no rare earth is contained and in which a high-temperature creep strength is improved. For example, Patent Document 1 discloses a magnesium alloy which contains 3.0 mass % or sore but 7.0 mass % or less of Al, 0.1 mass % or more but 0.6 mass % or less of Mn, 1.5 mass % or more of Ca and 0.4 mass % or more of Si, in which the remaining part is formed of Mg and an inevitable impurity and in which a mass ratio of Ca/Si is 2.0 or more. In this magnesium alloy, its creep resistance is high in an environment of 170° C. or more, and its creep distortion is reduced to 0.20% or less.

Patent Document 2 discloses a magnesium alloy which contains 0.5 to 5 mass 1 of Ca and 0.5 to 5 mass % of Si, in which a Ca—Mg—Si phase is crystallized in an Mg phase serving as a mother phase so as to have heat resistance and in which an $Al_2Ca$ phase is crystallized in the grain boundary of the Mg phase so as to enhance the hardness.

Patent Document 1: Japanese Unexamined Patent Application, Publication No. 2014-1428

Patent Document 2: Japanese Unexamined Patent Application, Publication No. 2013-19030

SUMMARY OF THE INVENTION

However, a conventional Mg—Al—Ca—Si alloy is not sufficient as the material of a product used under a high-temperature environment. When the conventional magnesium alloy is used as the material of a high-temperature component, the temperature of the component is excessively increased depending on the environment of the use, and consequently, the mechanical strength of the component is lowered, with the result that an even larger high-temperature strength is needed for the component material. In particular, in an engine member such as an engine block, a high-temperature strength for withstanding, under a high-temperature environment, an explosion load in a combustion chamber for a long period of time is required.

Hence, the present invention has an object to provide an Mg—Al—Ca—Si-based heat-resistant magnesium alloy which has satisfactory mechanical properties in a high-temperature region of about 200° C.

In view of the problem described above, the present inventors have performed thorough examinations. The present inventors have focused attention on the fact that since the conventional heat-resistant magnesium alloy cannot acquire sufficient heat dissipation as compared with a heat-resistant aluminum alloy, the temperature of the component is increased to lower the mechanical strength. Hence, in order to enhance the heat dissipation of an Mg alloy, thermal conductivity is examined. Consequently, it is found that the Mg purity of an Mg mother phase is kept high, and thus it is possible to realize a high thermal conductivity. Furthermore, it is also found that it is possible to obtain a nigh high-temperature strength with a $(Mg, Al)_2Ca$ phase formed in the crystal grain boundary of the Mg mother phase and a Ca—Mg—Si-based compound phase. In this way, in the present invention, a heat-resistant magnesium alloy is completed which achieves both a satisfactory high-temperature strength and thermal conductivity in a high-temperature region.

Conventionally, a heat-resistant magnesium alloy that achieves both a high high-temperature strength and a high thermal conductivity is not known. As described above, the engine member needs to withstand an explosion load within a high-temperature combustion chamber. Furthermore, an engine component using a magnesium alloy also has such heat dissipation as to appropriately maintain the temperature of the combustion chamber, and thus it is possible to realize weight saving and the enhancement of fuel efficiency.

In the present invention, contents of Ca, Al and Si and a value of a relational formula between Al and Ca are selected in specific ranges, and thus in a crystal grain boundary around an Mg mother phase (crystal grains), a $(Mg, Al)_2Ca$ phase continuous in the shape of a three-dimensional mesh is formed and is used as a skeleton for enhancing the strength of a magnesium alloy. A Ca—Mg—Si-based compound phase is formed within the crystal grain boundary to enhance the strength. Furthermore, alloy elements are prevented from being solid-soluble in the Mg mother phase, the Mg purity of the Mg mother phase is kept high and thus it is possible to obtain a high thermal conductivity. Specifically, the present invention provides the followings.

(1) A magnesium alloy including Mg, Ca, Al and Si, where a content of Ca is less than 9.0 mass %, a content of Al is equal to or more than 0.5 mass % but less than 5.7 mass %, a content of Si is equal to or less than 1.3% mass and $$Al+8Ca \geq 20.5\%.$$

(2) A magnesium alloy including Mg, Ca, Al and Si, where a content of Ca is less than 9.0 mass a content of Al is equal to or more than 0.5 mass % but less than 5.7 mass %, a content of Si is more than 1.0 mass % but equal to or less than 3.0 mass %, $$Al+8Ca \geq 20.5\% \text{ and}$$

a composition ratio Ca/Si of Ca to Si is less than 1.5.

(3) A magnesium alloy including Mg, Ca, Al and Si, where a content of Ca is less than 9.0 mass %, a content of Al is equal to or more than 0.5 mass % but less than 5.7 mass %, a content of Si is equal to or less than 3.0 mass % and a $(Mg, Al)_2Ca$ phase continuous in a shape of a three-dimensional mesh is provided.

(4) The magnesium alloy according to (3), where a thermal conductivity is equal to or more than 70.0 W/m·K.

(5) The magnesium alloy according to (3), where a tensile strength at 200° C. is equal to or more than 170 MPa.

(6) The magnesium alloy according to (1), where a composition ratio Al/Ca of Al to Ca is equal to or less than 1.70.

(7) The magnesium alloy according to (2), where a composition ratio Al/Ca of Al to Ca is equal to or less than 1.70.

(8) The magnesium alloy according to (3), where a composition ratio Al/Ca of Al to Ca is equal to or less than 1.70.

(9) The magnesium alloy according to (1), where a Ca—Mg—Si-based compound phase is provided in a Mg mother phase.

(10) The magnesium alloy according to (2), where a Ca—Mg—Si-based compound phase is provided in an Mg mother phase.

(11) The magnesium alloy according to (3), where a Ca—Mg—Si-based compound phase is provided in an Mg mother phase.

(12) The magnesium alloy according to (1), where an Mg purity of an Mg mother phase is equal to or more than 98.0%.

(13) The magnesium alloy according to (2), where an Mg purity of an Mg mother phase is equal to or more than 98.0%.

(14) The magnesium alloy according to (3), where an Mg purity of an Mg mother phase is equal to or more than 98.0%.

(15) A method of manufacturing the magnesium alloy according to (1), the method including:

cooling a molten metal material at a rate which is less than $10^3$ K/second.

(16) A method of manufacturing the magnesium alloy according to (2), the method including:

cooling a molten metal material at a rate which is less than $10^3$ K/second.

(17) A method of manufacturing the magnesium alloy according to (1), the method including:

cooling a molten metal material to crystallize a $(Mg, Al)_2Ca$ phase continuous in a shape of a three-dimensional mesh, a Ca—Mg—Si-based compound phase and an Mg mother phase.

(18) An engine member including the magnesium casting alloy according to (1).

(19) An engine member including the magnesium casting alloy according to (2).

(20) An engine Member including the magnesium casting all y according to (3).

In the present invention, it is possible to obtain a heat-resistant magnesium alloy that achieves both satisfactory mechanical properties and thermal conductivity in a high-temperature region of about 200° C. Hence, it is possible to provide a lightweight, high-strength material that is suitable for use under a high-temperature environment such as an engine member, and thus it is possible to realize weight saving and the enhancement of fuel efficiency in an engine of an automobile or the like. Since the magnesium alloy of the present invention has a satisfactory heat dissipation, it is possible to appropriately maintain the temperature of components of an engine or the like, to appropriately maintain a clearance between components caused by thermal expansion and to prevent the occurrence of a failure in the components. Since the magnesium alloy of the present invention does not contain an expensive rare earth, it is possible to provide a low-cost material.

DETAILED DESCRIPTION OF THE INVENTION

Figure 1:
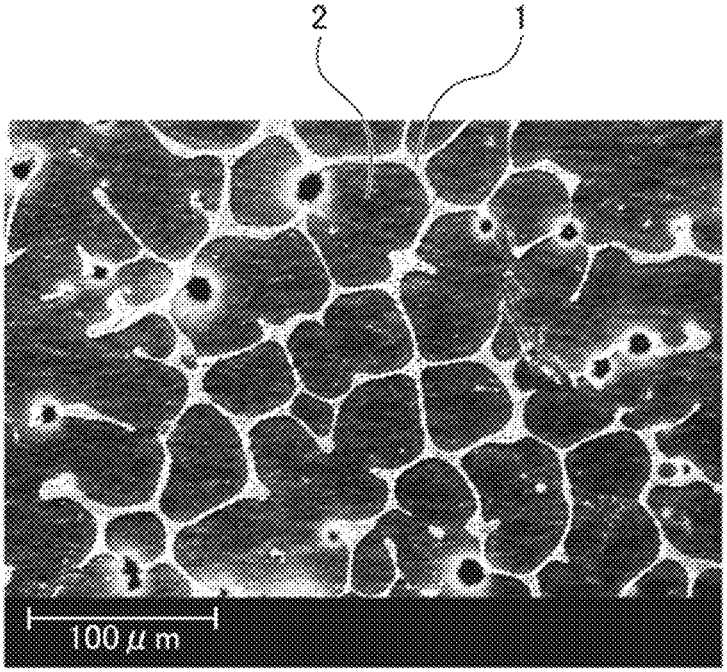
FIG. 1 is an electron micrograph showing the metal structure of a casting magnesium alloy in example 6.

A preferred embodiment of the present invention will be described below. The present invention should not be interpreted to be limited by the embodiment.

The magnesium alloy of the present embodiment is a heat-resistant magnesium alloy which contains 9.0 mass % or less of Ca, 0.5 mass % or more but less than 5.7 mass % of Al and 1.3 mass % or less of Si, in which the remaining part is formed of Mg and an inevitable impurity and in which Al+8Ca≥20.5%.

(Alloy Composition)

In the metal structure of the magnesium alloy according to the present embodiment, a $(Mg, Al)_2Ca$ phase continuous in the shape of a three-dimensional mesh is formed in a crystal grain boundary around an Mg mother phase (crystal grains), and a Ca—Mg—Si-based compound phase is formed within the crystal grains. These intermetallic compound phases contribute to the enhancement of a high-temperature strength.

Ca is an element which is necessary for the formation of the $(Mg, Al)_2Ca$ phase and the Ca—Mg—Si-based compound phase, and as will be described later, Ca can be contained in a range that satisfies Al+8Ca≥20.5%. When the content of Ca is excessive, there is a possibility that a ratio of Ca solid-soluble within the Mg mother phase is increased, that the Mg purity of the Mg mother phase is lowered and that the thermal conductivity is reduced. Hence, the content of Ca is preferably less than 9.0%, and is more preferably equal to or less than 4.0%. The lower limit of the content of Ca is preferably equal to or more than 2.5%.

Al is an element which is necessary for the formation of the $(Mg, Al)_2Ca$ phase, and as will be described later, Al can be contained in a range that satisfies Al+8Ca≥20.5%. When the content of Al is excessive, there is a possibility that a ratio of Al solid-soluble in the Mg mother phase is increased, that the Mg purity of the Mg mother phase is lowered and that the thermal conductivity is reduced. Hence, the content of Al is preferably equal to or less than 5.0%, and is more preferably equal to or less than 3.0%. The lower limit of the content of Al is preferably equal to or more than 0.5%, and is more preferably equal to or more than 1%.

In the present embodiment, Ca and Al need to satisfy the relationship of formula (1) below.

$$Al+8Ca \geq 20.5\% \qquad \text{formula (1)}$$

When Ca and Al satisfies the relationship of formula (1) above, the $(Mg, Al)_2Ca$ phase described above is formed so as to enhance the high-temperature strength. Hence, Al+8Ca is preferably 24% or more. On the other hand, when the contents of Al and Ca are excessive, there is a possibility that the Mg purity of the Mg mother phase is lowered and that the thermal conductivity is reduced. Hence, the upper limit of Al+8Ca is preferably 32% or less.

In the present embodiment, Al/Ca is preferably equal to or less than 1.70. As described above, Al forms the $(Mg, Al)_2Ca$ phase together with Ca. However, when Al is excessively contained, there is a possibility that a ratio of extra Al solid-soluble in the Mg mother phase is increased and that the Mg purity of the Mg mother phase is lowered. Al/Ca is preferably equal to or less than 1.70 in that Al is prevented from being solid-soluble in the Mg mother phase and that the thermal conductivity is enhanced. Al/Ca may be equal to or less than 1.0. In the formation of the $(Mg, Al)_2Ca$ phase, Al/Ca is preferably equal to or more than 0.2. For example, when the thermal conductivity of the magnesium alloy falls within a predetermined range, Al/Ca may exceed 1.70. Al/Ca may be less than 0.2.

Si is an element which is necessary for the formation of the Ca—Mg—Si-based compound phase. However, when the content of Si is high, a coarse Si—Ca-based compound which chemically combines with Ca is generated. There is a tendency that this Si—Ca-based compound inhibits the continuous formation of the $(Mg, Al)_2Ca$ phase in the shape of a three-dimensional mesh and lowers the high-temperature strength of the magnesium alloy. Hence, the content of Si is preferably equal to or less than 1.3%, and is more preferably equal to or less than 1.0%. In the formation of the Ca—Mg—Si-based compound phase, the content of Si is preferably equal to or more than 0.2%.

The heat-resistant magnesium alloy of the present embodiment can contain Mn. Mn has an action of enhancing the corrosion resistance of the magnesium alloy. The content of Mn is preferably equal to or more than 0.1% but equal to or less than 0.5%, and is more preferably equal to or more than 0.2% but equal to or less than 0.4%. For example, when the corrosion resistance of the magnesium alloy falls within a predetermined range, the content of Mn may be less than 0.1% or may be more than 0.5%.

In the heat-resistant magnesium alloy of the present embodiment, the remaining part is formed of Mg and an inevitable impurity. The inevitable impurity may be contained as long as it does not affect the properties of the present magnesium alloy.

The Mg purity of the Mg mother phase refers to a content of Mg in the crystal grains in the metal structure of the magnesium alloy. In the magnesium alloy of the present embodiment, the mixed ingredients other than Al are elements which are lower in thermal conductivity than Mg. Hence, as the Mg purity of the Mg mother phase is increased, the thermal conductivity of the Mg mother phase is enhanced. Consequently, the thermal conductivity of the magnesium alloy is enhanced. On the other hand, when the ingredients other than Mg are solid-soluble in the Mg mother phase, and thus the Mg purity is lowered, the thermal conductivity of the magnesium casting alloy is also easily lowered. Preferably, when the Mg purity of the Mg mother phase is 98% or more, it is possible to obtain a thermal conductivity of 80.0 W/m·K or more. More preferably, the Mg purity is 99.0% or more. For example, when the thermal conductivity of the magnesium alloy falls within a predetermined range, the Mg purity of the Mg mother phase may be less than 98.0%.

The magnesium alloy of the present embodiment has the $(Mg, Al)_2Ca$ phase continuous in the shape of a three-dimensional mesh. When the magnesium alloy is cast, Mg, Ca and Al form a network structure in the crystal grain boundary, and thus the tensile strength of the magnesium alloy at a high temperature is enhanced. FIG. 1 is an electron micrograph showing the metal structure of a casting magnesium alloy in example 6. As shown in FIG. 1, the $(Mg, Al)_2Ca$ phase 1 is formed in the shape of a three-dimensional mesh around the Mg mother phase 2.

Figure 4:
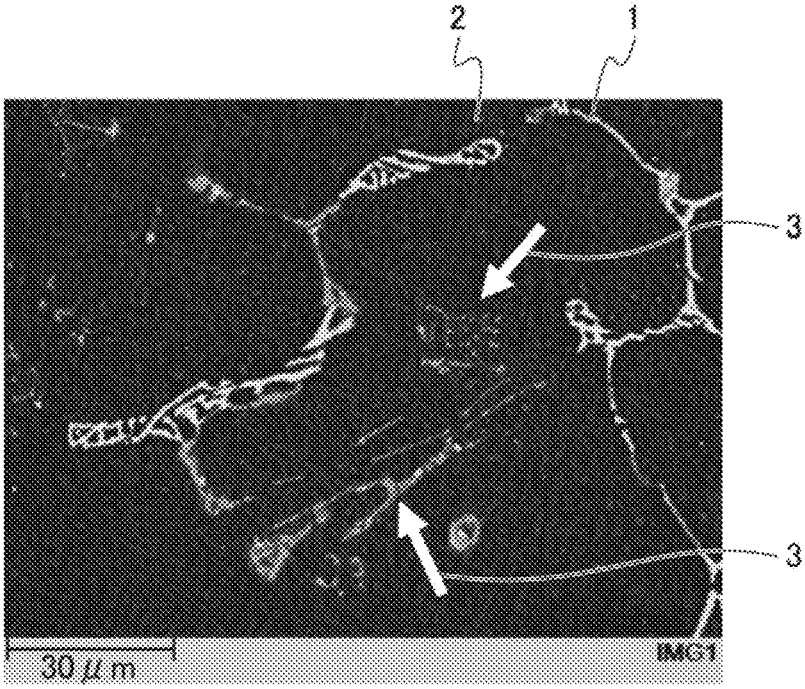
FIG. 4 is an electron micrograph showing the metal structure of a casting magnesium alloy in example 3.

The magnesium alloy of the present embodiment preferably has the Ca—Mg—Si-based compound phase in the Mg mother phase. There is a tendency that the Ca—Mg—Si-based compound phase reinforces the interior of the crystal grains, and that thus the high-temperature strength of the magnesium alloy is enhanced. FIG. 4 is an electron micrograph showing the metal structure of a casting magnesium alloy in example 3. As shown in FIG. 4, the Ca—Mg—Si-based compound phase 3 is formed in the Mg mother phase 2, and thus a high-temperature strength of 170 MPa or more at 200° C. is provided. For example, when the high-temperature strength of the magnesium alloy falls within a predetermined range, the Ca—Mg—Si-based compound phase does not need to be provided in the Mg mother phase.

(Thermal Conductivity)

A conventional commercially available magnesium alloy (AZ91D (comparative example 5) and WE54 (comparative example 6)) has a thermal conductivity of 51 to 52 W/m·K, and the thermal conductivity is about half as high as the thermal conductivity (92 W/m·K) of an aluminum alloy (ADC12 material, comparative example 7). Hence, it is impossible to acquire sufficient heat dissipation as the material of a high-temperature component. By contrast, the magnesium alloy of the present embodiment has a satisfactory thermal conductivity of 70.0 W/m·K or more, and since it has satisfactory heat dissipation as the material of a high-temperate component, it is suitable as a heat-resistant magnesium alloy for an engine member. In order to acquire sufficient heat dissipation as the material of a high-temperature component, the thermal conductivity is more preferably 80 W/m·K or more, and is further preferably 90 W/m·K or more. For example, when the heat dissipation of the magnesium alloy falls within a predetermined range, the thermal conductivity may be less than 70 W/m·K.

(High-Temperature Strength)

In a general magnesium alloy, in a high-temperature region of about 200° C., mechanical properties such as a tensile strength and elongation are lowered, and thus it is impossible to obtain a high-temperature strength comparable to a heat-resistant aluminum alloy (such as the ADC12 material (comparative example 7) or an A4032-T6 material). By contrast, in the magnesium alloy of the present embodiment, the tensile strength at 200° C. has a high-temperature strength of 170 MPa or more. Hence, it is suitable as a heat-resistant magnesium alloy for an engine member used under a high-temperature environment. The tensile strength at 200° C. is preferably 185 MPa or more, and is more preferably 200 MPa or more. For example, when the magnesium alloy is not used for an engine member used under a high-temperature environment, the tensile strength at 200° C. may be less than 170 MPa.

Preferably, the magnesium alloy of the present embodiment contains less than 9.0 mass % of Ca, 0.5 mass % or more but less than 5.7 mass % of Al and more than 1.0 mass % but 3.0 mass % or less of Si, the remaining part is formed of Mg and an inevitable impurity, Al+8Ca≥20.5% and a composition ratio Ca/Si of Ca to Si is less than 1.5. When the content of Si is increased, a coarse compound in which Si and Ca are combined is generated, and thus the formation of the (Mg, Al)$_2$Ca phase continuous in the shape of a three-dimensional mesh is inhibited, with the result that the high-temperature strength of the magnesium alloy tends to be lowered.

However, the present inventor has found that even when the content of Si is more than 1.0% but equal to or less than 3.0%, as long as the composition ratio Ca/Si of Ca to Si is less than 1.5, the (Mg, Al)$_2$Ca phase continuous in the shape of a three-dimensional mesh is maintained, and that the high-temperature strength of the magnesium alloy is also maintained. Si is more preferably equal to or more than 1.5% but equal to or less than 3.0%, and is further preferably equal to or more than 1.5% but equal to or less than 2.5%. As for the range of values of the composition and the like, the preferable range described above can be applied as necessary.

Preferably, the magnesium alloy of the present embodiment contains 9.0 mass % or less of Ca, 0.5 mass % or more but less than. 5.7 mass % of Al and 3.0% or less of Si, the remaining part is formed of Mg and an inevitable impurity and the (Mg, Al)$_2$Ca phase continuous in the shape of a three-dimensional mesh is provided. When the content of Si is increased, a coarse compound in which Si and Ca are combined is generated, and thus the formation of the (Mg, Al)$_2$Ca phase continuous in the shape of a three-dimensional mesh is inhibited, with the result that the high-temperature strength of the magnesium alloy tends to be lowered. However, it has been found that even when the content of Si is equal to or less than 3.0%, the (Mg, Al)$_2$Ca phase continuous in the shape of a three-dimensional mesh is maintained, and that the high-temperature strength of the magnesium alloy is also maintained. Si is more preferably equal to or more than 1.5% but equal to or less than 3.0%, and is further preferably equal to or more than 1.5% but equal to or less than 2.5%. As for the range of values of the composition and the like, the preferable range described above can be applied as necessary.

Preferably, the magnesium alloy of the present embodiment contains 9.0 mass % or less of Ca, 0.5 mass % or more but less than 5.7 mass % of Al and 3.0% or less of Si, the remaining part is formed of Mg and an inevitable impurity and the thermal conductivity is 70 W/m·K or more and the tensile strength at 200° C. is 170 MPa or more. When the content of Si is increased, a coarse compound in which Si and Ca are combined is generated, and thus the formation of the (Mg, Al)$_2$Ca phase continuous in the shape of a three-dimensional mesh is inhibited, with the result that the high-temperature strength of the magnesium alloy tends to be lowered. However, even when the content of Si is equal to or less than 3.0%, it is possible to obtain a heat-resistant magnesium alloy that achieves both satisfactory mechanical properties and thermal conductivity in which the thermal conductivity is 70 W/m·K or more and the tensile strength at 200° C. is 170 MPa or more. As for the range of values of the composition and the like, the preferable range described above can be applied as necessary.

(Manufacturing Method)

In order to manufacture the magnesium alloy of the present embodiment, a metal material may be melted at a high temperature in which the metal material contains less than 9.0 mass % of Ca, 0.5% or more but less than 5.7 mass % of Al and 1.3 mass % or less of Si, the remaining part is formed of Mg and an inevitable impurity and Al+8Ca≥20.5%. Preferably, as for the process of melting the metal material at a high temperature, for example, the metal material is inserted into a graphite crucible, high-frequency induction melting is performed in an atmosphere of Ar and the metal material is melted at a temperature of 750 to 850° C.

The molten alloy obtained is preferably cast by being injected into a mold. In the process of the casting, the molten metal material is preferably cooled at a predetermined rate. Preferably, in a method of manufacturing the magnesium alloy according to the present embodiment, a process is provided of cooling the molten metal material and crystallizing the (Mg, Al)$_2$Ca phase continuous in the shape of a three-dimensional mesh and the Ca—Mg—Si-based compound phase and the Mg mother phase. In this way, it is possible to obtain a heat-resistant magnesium alloy that achieves both mechanical properties and thermal conductivity. The cooling rate is preferably less than $10^3$ K/second. When the cooling rate is less than $10^3$ K/second, in the coagulation of the Mg mother phase, a sufficient time is taken in which solid solution elements within the mother phase are discharged into a crystallized phase, and thus the solid solution elements are unlikely to be left in the Mg mother phase, and the thermal conductivity is unlikely to be lowered. The cooling rate is preferably $10^2$ K/second or less. When the thermal conductivity of the magnesium alloy obtained falls within a predetermined range, the cooling rate is preferably $10^3$ K/second or more.

(Application)

The magnesium alloy of the present embodiment can be applied to a lightweight component, such as an engine block or a piston, in which a high-temperature strength is required, and since it has a lower specific gravity than a conventional aluminum alloy engine component, it is possible to reduce its weight by 30% or more. It is possible to reduce an increase in the temperature of an engine member and the thermal expansion thereof, to optimize the clearance of a piston or a cylinder and to contribute to the enhancement of fuel efficiency and the quietness of an engine. Furthermore, it is possible to manufacture the magnesium alloy as an as-cast material without adding thermal processing and to increase the strength thereof without addition of a rear earth, with the result that it is possible to manufacture it inexpensively as compared with a conventional magnesium alloy.

EXAMPLES

The present invention will be specifically described below based on examples. The present invention should not foe interpreted to be limited by the examples.

Example 1

A metal material obtained by adding, to Mg, 1 mass % of Al, 3 mass % of Ca, 1 mass % of Si and 0.3 mass % of Mn was inserted into a graphite crucible, high-frequency induction melting was performed in an atmosphere of Ar and the metal material was melted at a temperature of 750 to 850° C. The molten alloy obtained was injected into a mold and was cast. At the time of the casting, the molten metal material was cooled. The size of the plate-shaped cast alloy obtained by the casting was 50 mm in width and 8 mm in thickness. When an Al—Cu eutectic alloy in which a relationship between a cooling rate and a dendrite secondary arm space was known was cast under the same conditions as in the example of the present application, and the cooling rate was analogized from the secondary arm space, the cooling rate was 55K/second.

Example 2-10, Comparative Example 1-9

Except that the composition was changed according to table 1, the melting and the casting were performed as in example 1, and thus magnesium alloys were manufactured. In comparative examples 5 to 7, literature values were used, and the composition ratios were as follows.

Comparative Example 5

(commercially available magnesium alloy AZ91D): 9.23% of Al, 0.78% of Zn, 0.31% of Mn and the remaining part of Mg.

Comparative Example 6

(commercially available magnesium alloy WE54): 5.23% of Y, 1.54% of RE, 1.78% of Nd, 0.51% of Zr and the remaining part of Mg.

Comparative example 7

(commercially available aluminum alloy ADC12): 1.93% of Cu, 10.5% of Si, 0.21% of Mg, 0.82% of Zn, 0.84% of Fe, 0.32% of Mn and the remaining part of Al.

Test specimens were cut out of the cast alloys of examples 1 to 10 and comparative examples 1 to 4, 8 and 9 for individual measurements, and the following measurements were performed. The results of the measurements are shown in table 1.

(Thermal Conductivity)

The measurements were performed as follows based on JIS R 1611 by a laser flash method.

1) In order to enhance the absorption and the emissivity of heat, a blackening material (carbon spray) was applied to the front and rear surfaces of the casting alloy sample.
2) Pulse laser light was applied to the surface of the sample.
3) A temperature history curve in which the sample temperature was increased with time and was decreased again was obtained.
4) According to the following formula (1), a specific heat capacity Cp was determined from the reciprocal of a temperature increase amount θm.

$$Cp=Q/(M\cdot\theta m) \quad \text{formula (1)}$$

(Q: amount of heat input (pulse light energy), M: mass of the sample)

5) According to the following formula (2), a thermal diffusivity α was determined from a time $t_{1/2}$ which was needed such that the temperature was increased only by a half of the temperature increase amount.

$$\alpha=0.1388d^2/t_{1/2} \quad \text{formula (2)}$$

(d=thickness of the specimen)

6) According to the following formula (3), a thermal conductivity λ was determined from the specific heat capacity Cp, the thermal diffusivity α and the density ρ of the specimen.

$$\lambda=\alpha\cdot Cp\cdot\mu \quad \text{formula (3)}$$

A measurement device and measurement conditions used in the measurement of the thermal conductivity are as follows.

Measurement device: TC7000 model made by ULVAC-RIKO Inc.

Laser pulse width: 0.4 ms

Laser pulse energy: 10 joule/pulse or more

Laser wavelength: 1.06 μm (Nd glass laser)

Laser beam diameter: 10ϕ

Temperature measurement method: infrared sensor (thermal diffusivity measurement) and thermocouple (specific heat capacity measurement)

Measurement temperature range: room temperature to 1400° C. (simultaneous measurements on the specific heat capacity were performed up to 800° C.)

Measurement atmosphere: vacuum

Sample: diameter of 10 mm and thickness of 2.0 mm (Tensile Strength)

The tensile strength was measured as follows.

A tensile test specimen was formed in the shape of an ASTM E8 standard specimen having a parallel portion diameter of 6.35 mm and a reference point interval distance of 25.4 mm The specimen was heated with a high-frequency heating coil and was then retained for 30 minutes, the temperature was stabilized and thereafter the test was performed.

The test conditions were as follows.

Distortion rate: $5\times10^{-4}$/sec

Test temperature: 200±2° C.

Criteria for the tensile strength (which may be referred to as the high-temperature strength) at 200° C. are as follows, A indicates that the tensile strength was excellent, and B indicates that the tensile strength was sufficient. On the other hand, C or D indicates that the tensile strength was not sufficient.

A: 200 MPa or more

B: 170 MPa or more but less than 200 MPa

C: 140 MPa or more but less than 170 MPa

D: Less than 140 MPa (Mg Purity of Mg Mother Phase)

The Mg mother phase of each sample was observed with an electronic microscope, the composition of the Mg mother phase portion was measured at five points by point analysis and the average value thereof (the mass % of Mg) was used as the mother phase Mg purity.

Measurement device: JSM-7100 model scanning electron microscope made by JEOL Ltd.: JED-2300 model energy dispersive X-ray analyzer made by JEOL Ltd.

Acceleration voltage: 15 kV

Observation field: 400 times (Network Structure Form)

The metal structure of each sample was analyzed by an electron beam backscatter diffraction method (EBSD method), and the length L1 of a crystal grain boundary and the length L2 of the $(Mg, Al)_2Ca$ phase continuous in the shape of a three-dimensional mesh were measured by image processing. A measurement region was a region of about 300 μm×200 μm in the cross section of the center portion of the casting alloy which was the sample, was magnified 400 times and was measured. A network formation rate was calculated by L2/L1×100, and evaluation was performed with criteria A to C below.

A: satisfactory network formation (80% or more)

B: network formation was partially divided (50 to 79%)

C: network formation was divided (less than 50%)

TABLE 1

| | | Amount of each alloy element added (mass %) | | | | | | | Network structure | High-temperature strength | Thermal conductivity | Mg purity |
|---|---|---|---|---|---|---|---|---|---|---|---|---|
| | | Al | Ca | Si | Mn | Others | Al + 8Ca | Al/Ca | form | (MPa 200° C.) | (W/m · k) | (%) |
| Example | 1 | 1 | 3 | 1 | 0.3 | — | 25 | 0.33 | A | B | 113 | 99.2 |
| Example | 2 | 1 | 4 | 1 | 0.3 | — | 33 | 0.25 | A | B | 115 | 99.5 |
| Example | 3 | 2 | 3 | 1 | 0.3 | — | 26 | 0.67 | A | B | 105 | 97.9 |
| Example | 4 | 2 | 4 | 1 | 0.3 | — | 34 | 0.5 | A | A | 95.1 | 98.4 |
| Example | 5 | 3 | 3 | 1 | 0.3 | — | 27 | 1.0 | A | A | 89.4 | 98.1 |
| Example | 6 | 4 | 2.5 | 1 | 0.3 | — | 24 | 1.6 | A | A | 83.2 | 97.7 |
| Example | 7 | 4 | 4 | 1 | 0.3 | — | 36 | 1.0 | A | A | 87.4 | 98.2 |
| Example | 8 | 5 | 2 | 1 | 0.3 | — | 21 | 2.5 | A | B | 70.2 | 98.5 |
| Example | 9 | 5 | 3 | 1 | 0.3 | — | 29 | 1.67 | A | B | 73.8 | 97.0 |
| Example | 10 | 4 | 2.5 | 2 | 0.3 | — | 24 | 1.6 | A | B | 71.2 | 98.9 |
| Comparative Example | 1 | 0.3 | 3 | 1 | 0.3 | — | 24.3 | 0.1 | B | C | 117 | 99.3 |
| Comparative Example | 2 | 3 | 2 | 1 | 0.3 | — | 19 | 1.5 | C | D | 88.7 | 97.9 |
| Comparative Example | 3 | 6 | 1 | 1 | 0.3 | — | 14 | 6.0 | C | C | 61.5 | 95.4 |
| Comparative Example | 4 | 3 | 3 | 2 | 0.3 | — | 27 | 1.0 | C | D | 84.3 | 97.8 |
| Comparative Example | 5 | 9.2 | — | — | 0.31 | Zn 0.78% | — | — | B | C | 51 | 88.5 |
| Comparative Example | 6 | — | — | — | — | Remark 1 | — | — | A | A | 52 | 89.1 |
| Comparative Example | 7 | Remaining part | — | 10.5 | 0.32 | Remark 2 | — | — | — | B | 92 | — |
| Comparative Example | 8 | 6 | 2.2 | 0.7 | 0.3 | — | 23.6 | 2.73 | A | C | 70.6 | 98.6 |
| Comparative Example | 9 | 12 | 1 | 1 | 0.3 | Zn 0.7% | 20 | 12.0 | B | C | 42.5 | 91.6 |

Remark 1: Y: 5.23, RE: 1.54, Nd: 1.78, Zr: 0.51 (commercially available magnesium alloy WE54)
Remark 2: Cu 1.93, Mg: 0.21, Zn: 0.82, Fe: 0.84 (commercially available aluminum alloy ADC12)

As shown in table 1, in examples 1 to 10, the network structure form in the metal structure was satisfactorily formed, the high-temperature strength was high and the thermal conductivity was also excellent. FIG. 1 shows the metal structure of example 6, and the network structure of the $(Mg, Al)_2Ca$ phase 1 continuous in the shape of a three-dimensional mesh was densely formed. In examples 1 to 10, the Ca—Mg—Si-based compound phase was formed within the crystal grains.

Figure 2:
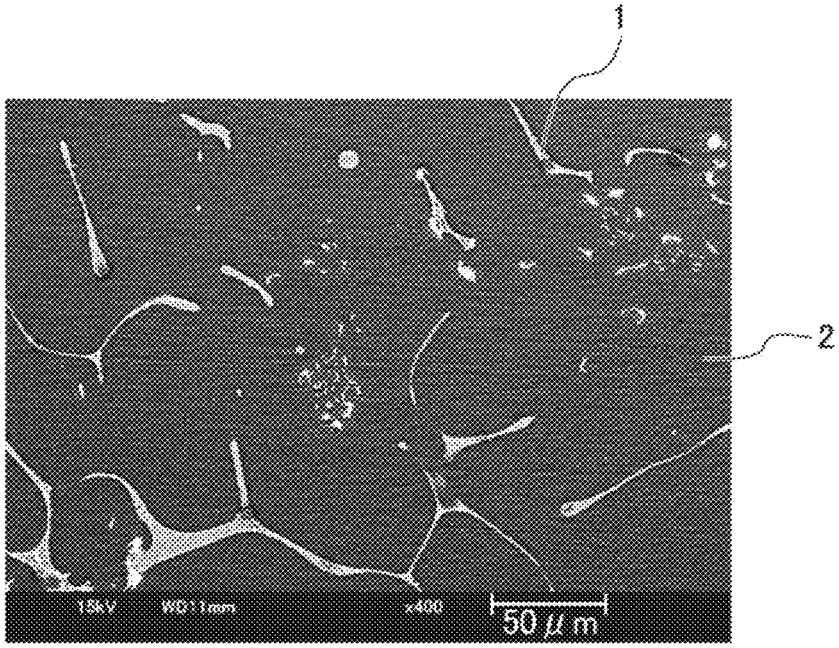
FIG. 2 is an electron micrograph showing the metal structure of a casting magnesium alloy in comparative example 2.

In comparative example 1, the high-temperature strength was not sufficient. It can be considered that this is because Al was small in amount so as to be 0.3% and thus the formation of the network structure of the $(Mg, Al)_2Ca$ phase was not sufficient. In comparative example 2, the high-temperature strength was also low. It is estimated that this is because the relational formula (Al+8Ca≥20.5%) between Al and Ca was not satisfied, and as shown in FIG. 2, the network structure form in the metal structure was divided.

In comparative example 3, the high-temperature strength was not sufficient, and the thermal conductivity was lowered. The reason why the high-temperature strength was not sufficient can be considered to be that the relational formula (Al+8Ca≥20.5%) between Al and Ca was not satisfied, and that the network structure form in the metal structure was divided. The reason why the thermal conductivity was lowered can be considered to be that the content of Al was high so as to be 6 mass %, that the Al/Ca ratio was high so as to foe 6.0 and that thus Al was solid-soluble in the Mg mother phase.

Figure 3:
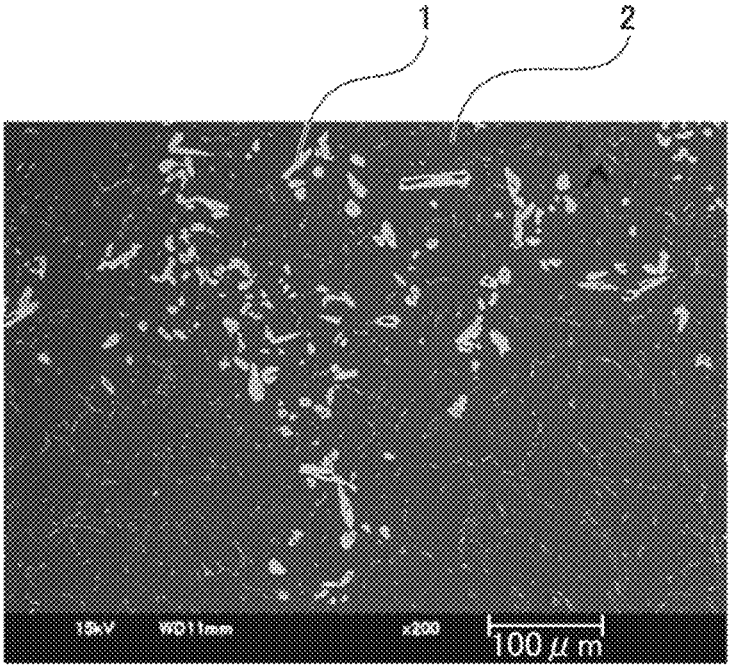
FIG. 3 is an electron micrograph showing the metal structure of a casting magnesium alloy in comparative example 4.

In comparative example 4, the content of Si was high so as to be 2 mass %, and the composition ratio Ca/Si of Ca to Si was high so as to be 1.5. It can be considered that this caused a coarse compound in which Si and Ca were combined to be generated, that as shown in FIG. 3, the network form was collapsed and that the high-temperature strength was lowered. On the other hand, in example 10, although the content of Si was 2 mass %, the composition ratio Ca/Si of Ca to Si was low so as to be 1.25. Hence, the network form was satisfactorily formed, the high-temperature strength was high and the thermal conductivity was 71.2 W/m·K. In example 3 where the amount of Si added was 1 mass %, it can be considered that as shown in FIG. 4, the Ca—Mg—Si-based compound phase 3 was formed within the crystal grains, and that the Mg mother phase 2 was reinforced.

In comparative example 5 of the commercially available magnesium alloy AZ91D and comparative example 6 of the heat-resistant magnesium alloy WE54, the thermal conductivity of comparative example 5 was low so as to be 51 W/m·K, and the thermal conductivity of comparative example 6 was also low so as to be 52 W/m·K.

In comparative example 7 of the heat-resistant aluminum alloy ADC12, the thermal conductivity was 92 W/m·K. By contrast, in the magnesium alloys of examples 1 to 4 where the content of Al was low, the thermal conductivity was high so as to be 95.1 to 115 W/m·K as compared with comparative example 7. In the magnesium alloys of examples 5 and 7 where the content of Al was high, the thermal conductivity was equivalent to that of the heat-resistant aluminum alloy of comparative example 7, and the high-temperature strength was high. In example 6, the ratio Al/Ca was slightly high so as to be 1.6. Hence, it can be considered that Al was solid-soluble in the Mg mother phase, and that thus the thermal conductivity was slightly lowered as compared with examples 5 and 7. In examples 8 and 9, the ratios Al/Ca were high so as to be respectively 2.5 and 1.67 as compared with example 6. Hence, it can be considered that the thermal conductivity was lowered as compared with example 6. In comparative example 9, the ratio Al/Ca was significantly high so as to be 12. Hence, the thermal conductivity was significantly lowered so as to be 42.5 W/m·K.

EXPLANATION OF REFERENCE NUMERALS

1: $(Mg, Al)_2Ca$ phase
2: Mg mother phase
3: Ca—Mg—Si-based compound phase

What is claimed is:

1. A magnesium alloy consisting of Mg, Ca, Al, Si and Mn,
wherein a content of Ca is less than 9.0 mass %,
a content of Al is at least 1.0 mass % but no more than 4.0 mass %,
a content of Si is at least 0.2 mass % but no more than 1.0 mass %,
an Al/Ca ratio is equal to or less than 1.6,
a content of Mn is at least 0.1 mass % but no more than 0.5 mass %,
a remainder being Mg and inevitable impurities, and
Al+8Ca24.0 mass %.

2. A magnesium alloy consisting of Mg, Ca, Al, Si and Mn,
wherein a content of Ca is less than 9.0 mass %,
a content of Al is at least 1.0 mass % but no more than 4.0 mass %,
a content of Si is at least 0.2 mass % but no more than 1.0 mass %,
an Al/Ca ratio is no more than 1.6,
a content of Mn is at least 0.1 mass % but no more than 0.5 mass %,
a remainder being Mg and inevitable impurities, and
a $(Mg, Al)_2Ca$ phase continuous in a shape of a three-dimensional mesh is provided.

3. The magnesium alloy according to claim 2, wherein a thermal conductivity is equal to or more than 80.0 W/m·K.

4. The magnesium alloy according to claim 2, wherein a tensile strength at 200° C. is equal to or more than 170 MPa.

5. The magnesium alloy according to claim 1, wherein a Ca—Mg—Si-based compound phase is provided in an Mg mother phase.

6. The magnesium alloy according to claim 2, wherein a Ca—Mg—Si-based compound phase is provided in an Mg mother phase.

7. The magnesium alloy according to claim 1, wherein an Mg purity of an Mg mother phase is equal to or more than 98.0%.

8. The magnesium alloy according to claim 2, wherein an Mg purity of an Mg mother phase is equal to or more than 98.0%.

9. A method of manufacturing the magnesium alloy according to claim 1, the method comprising:
cooling a molten metal material at a rate which is less than $10^3$ K/second.

10. A method of manufacturing the magnesium alloy according to claim 1, the method comprising:
cooling a molten metal material to crystallize a $(Mg, Al)_2Ca$ phase continuous in a shape of a three-dimensional mesh, a Ca—Mg—Si-based compound phase and a Mg mother phase.

11. An engine member comprising the magnesium casting alloy according to claim 1.

12. The magnesium alloy according to claim 1, wherein a content of Ca is no more than 4.0 mass %.

13. The magnesium alloy according to claim 2, wherein a content of Ca is no more than 4.0 mass %.

* * * * *